US007474281B2

(12) United States Patent
Lin et al.

(10) Patent No.: US 7,474,281 B2
(45) Date of Patent: Jan. 6, 2009

(54) MULTI-MODE SWITCH FOR PLASMA DISPLAY PANEL

(75) Inventors: Shin-Chang Lin, Taipei Hsien (TW); Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 457 days.

(21) Appl. No.: 11/425,156

(22) Filed: Jun. 20, 2006

(65) Prior Publication Data

US 2006/0290342 A1 Dec. 28, 2006

Related U.S. Application Data

(60) Provisional application No. 60/595,305, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66, 211; 313/567; 315/169.3, 315/169.4

See application file for complete search history.

(56) References Cited

U.S. PATENT DOCUMENTS 6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
7,385,569 B2 * 6/2008 Chen et al. ..... 345/66
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0104866 A1 * 6/2004 Sano et al. ..... 345/60
2004/0135746 A1 * 7/2004 Lee et al. ..... 345/60
2005/0179621 A1 * 8/2005 Kang et al. ..... 345/60
2006/0238447 A1 * 10/2006 Chen ..... 345/60
2006/0267874 A1 * 11/2006 Chen et al. ..... 345/68
2008/0106206 A1 * 5/2008 Hooke et al. ..... 315/111.21

* cited by examiner

*Primary Examiner*—Ricardo L Osorio
(74) *Attorney, Agent, or Firm*—Winston Hsu

(57) ABSTRACT

A claimed multiple mode switch includes an input signal interface for receiving first and second input signals and producing a combined input signal; a driving circuit for receiving the combined input signal and producing driving signals accordingly; a resistor mode circuit electrically connected to a first output of the driving circuit, to a first node, and to a second node for enabling the multiple mode switch to operate in variable resistor mode or in large resistor mode; a fully-on mode circuit electrically connected to the second input signal, the first output of the driving circuit, and the second node for enabling the multiple mode switch to operate in fully-on mode; and a power switch electrically connected to the first node, the second node, and a third node for controlling switching of the multiple mode switch between off mode, fully-on mode, and variable resistor mode or large resistor mode.

12 Claims, 4 Drawing Sheets

| S2 | S1 | IN | Node C | Q211 | Q221 | Status between A&B |
|---|---|---|---|---|---|---|
| 0 | 0 | 0 | 0 | Off | Off | Open |
| 0 | 1 | 1 | 1 | Off | On | Variable resistance |
| 1 | 0 | 1 | 1 | On | On | Almost short |
| 1 | 1 | Does not exist | | | | |

Fig. 3

MULTI-MODE SWITCH FOR PLASMA DISPLAY PANEL

CROSS REFERENCE TO RELATED APPLICATIONS

This application claims the benefit of the filing date of U.S. provisional patent application No. 60/595,305, filed Jun. 22, 2005, the contents of which are hereby incorporated by reference.

BACKGROUND OF THE INVENTION

1. Field of the Invention

The present invention relates to a multi-mode switch, and more specifically, to a multi-mode switch for a plasma display panel (PDP) or other applications.

2. Description of the Prior Art

The power switches in PDP driving circuits act in three modes. The first is in off-mode, the second is in fully on-mode and the third is in variable resistor mode or large resistor mode. In the prior art, it is necessary to use two power switches to cover the three modes.

SUMMARY OF THE INVENTION

It is therefore an objective of the invention to provide a multi-mode switch for PDP or other applications that solves the problems of the prior art.

Briefly summarized, the claimed multiple mode switch includes an input signal interface for receiving a first input signal and a second input signal and producing a combined input signal; a driving circuit for receiving the combined input signal and producing driving signals accordingly; a resistor mode circuit electrically connected to a first output of the driving circuit, to a first node, and to a second node for enabling the multiple mode switch to operate in variable resistor mode or in large resistor mode; a fully-on mode circuit electrically connected to the second input signal, the first output of the driving circuit and the second node for enabling the multiple mode switch to operate in fully-on mode; a power switch electrically connected to the first node, the second node and a third node for controlling switching of the multiple mode switch between off mode, fully-on mode and variable resistor mode or large resistor mode.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3 is a table summarizing how the input signals S1 and S2 affect the operation of the multi-mode switch.

DETAILED DESCRIPTION

Figure 1:
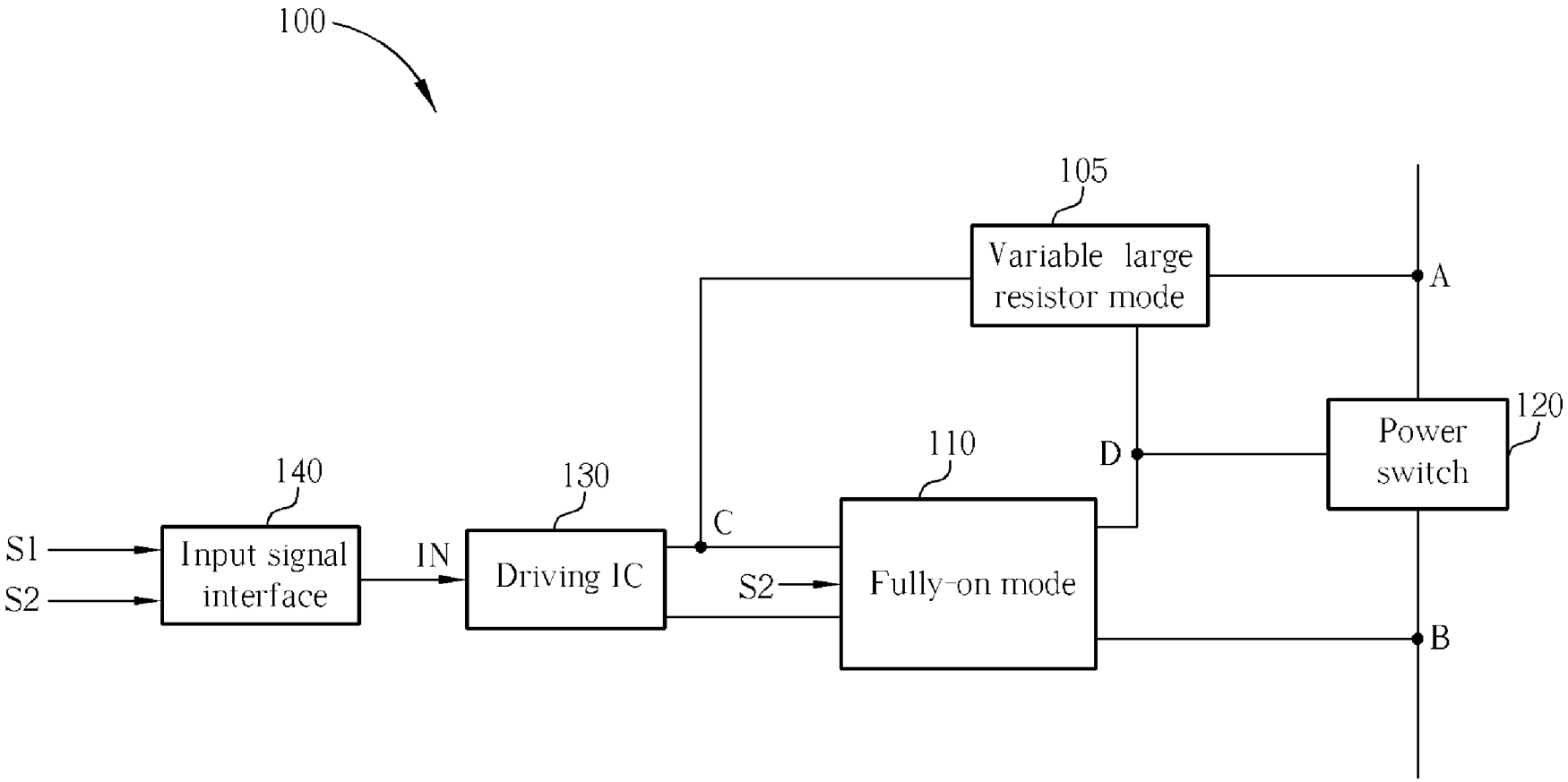
FIG. 1 is a functional block diagram of a multi-mode switch according to the present invention.

Please refer to FIG. 1. FIG. 1 is a functional block diagram of a multi-mode switch 100 according to the present invention. The multi-mode switch 100 comprises a variable large resistor mode circuit 105 for enabling the multi-mode switch 100 to operate in variable resistor mode or large resistor mode, a fully-on mode circuit 110 for enabling the multi-mode switch 100 to operate in fully on-mode, a power switch 120, and a driving IC 130. An input signal interface 140 receives system input signals S1 and S2, and outputs a combined input signal IN, which is provided to the driving IC 130. In addition, the fully-on mode circuit 110 also receives the input signal S2 as an input for controlling the operation of the fully-on mode circuit 110.

Figure 2:
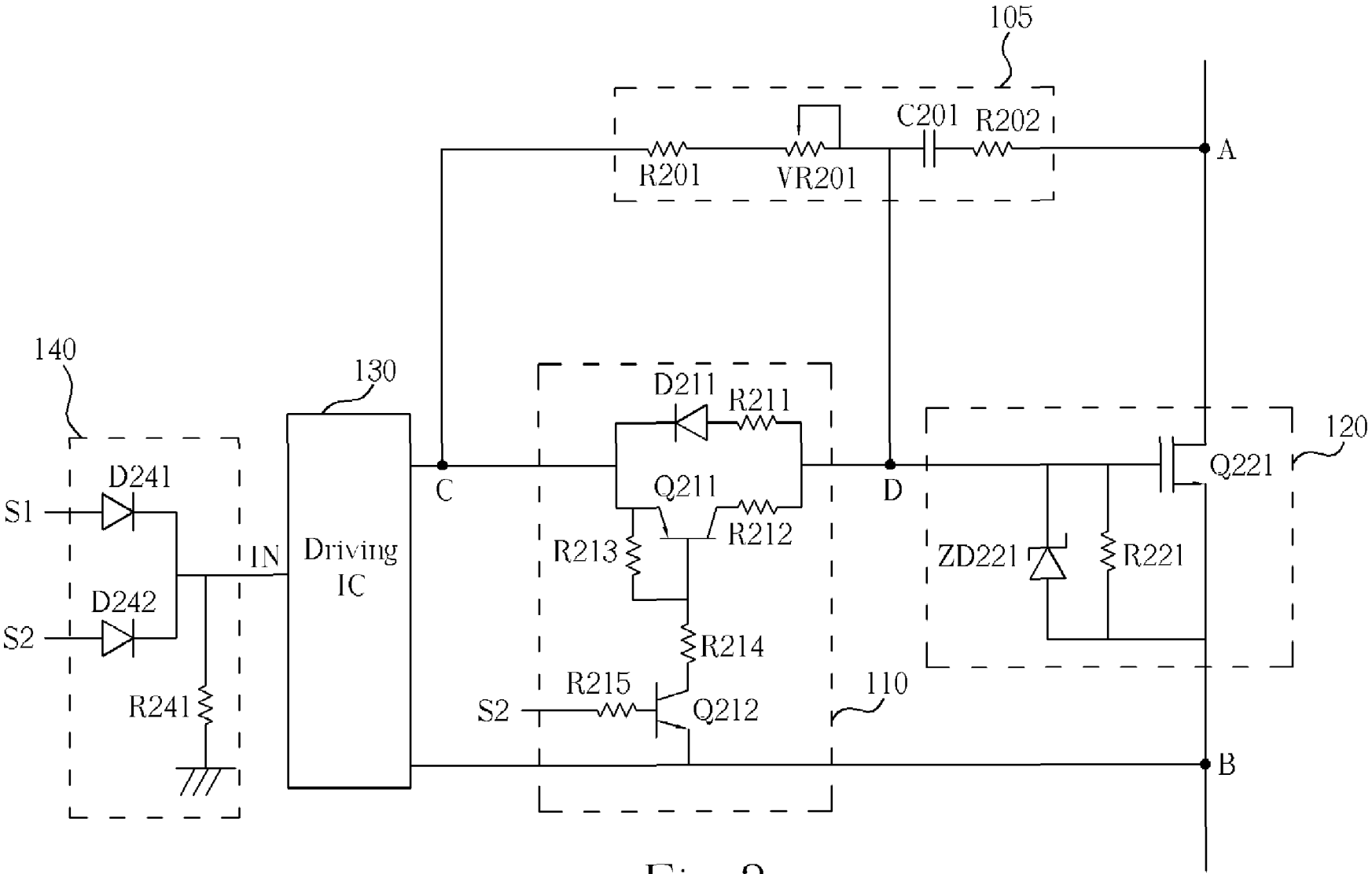
FIG. 2 is an equivalent circuit diagram of the multi-mode switch shown in FIG. 1.

Please refer to FIG. 2. FIG. 2 is an equivalent circuit diagram of the multi-mode switch 100 shown in FIG. 1. The variable large resistor mode circuit 105 comprises resistors R201 and R202, a capacitor C201, and a variable resistor VR201. When input signal S2 is low and input signal S1 is high, node C, which is electrically connected to a first output of the driving IC 130, will be high. This allows the power switch 120 to be driven through the variable large resistor mode circuit 105. In this case, the resistance between node A and node B will be variable, and the variable resistance can by adjusted by adjusting the variable resistor VR201.

The fully-on mode circuit 110 comprises resistors R211, R212, R213, R214 and R215, a diode D211, and transistors Q211 and Q212. In FIG. 2, the emitter of transistor Q212 is shown as being electrically connected to node B, which is also the second output of the driving IC 130. If input signal S2 is high and input signal S1 is low, node C will be high and transistors Q212 and Q211 will be also turned on by input signal S2. At this moment, node D will be pulled high directly by node C through transistor Q211 and resistor R212. On the other hand, if node C is low, node D will be pulled down through diode D211 and resistor R211.

The power switch 120 comprises transistor Q221, a resistor R221, and a Zener diode ZD221, although the resistor R221 and the Zener diode ZD221 are optional. The input signal interface 140 comprises a resistor R241 and diodes D241 and D242. The input signals S1 and S2 are input through the anodes of diodes D241 and D242, respectively. The input signal interface 140 receives the input signals S1 and S2 and produces the combined input signal IN.

The transistor Q221 is preferably an insulated gate bipolar transistor (IGBT), and is shown as being an N-type metal oxide semiconductor (NMOS) transistor. The transistors Q211 and Q212 are preferably BJT transistors, and are shown as being PNP and NPN types, respectively.

Please refer to FIG. 3. FIG. 3 is a table summarizing how the input signals S1 and S2 affect the operation of the multi-mode switch 100. When both input signals S1 and S2 are low (logical "0"), the combined input signal IN is also low, and the voltage value at node C is also low. This means that transistors Q211 and Q221 are turned off, and nodes A and B have an open circuit between them since transistor Q221 is turned off.

When input signal S1 is high and input signal S2 is low, the combined input signal IN is high since one of the input signals is high, and the voltage value at node C is also high. This means that transistor Q211 is turned off and transistor Q221 is turned on, and the power switch 120 is driven via the variable large resistor mode circuit 105. Therefore, nodes A and B have a variable resistance between them, according to the resistance of the variable resistor VR201.

When input signal S1 is low and input signal S2 is high, the combined input signal IN is high since one of the input signals is high, and the voltage value at node C is also high. Input S2 being high causes transistors Q211 and Q221 to turn on, and nodes A and B have almost no resistance between them, resulting in a near short between nodes A and B, thereby turning on the power switch 120. As shown in FIG.3, the situation in which both input signals S1 and S2 are high does not exist, and is therefore undefined.

Figure 4:
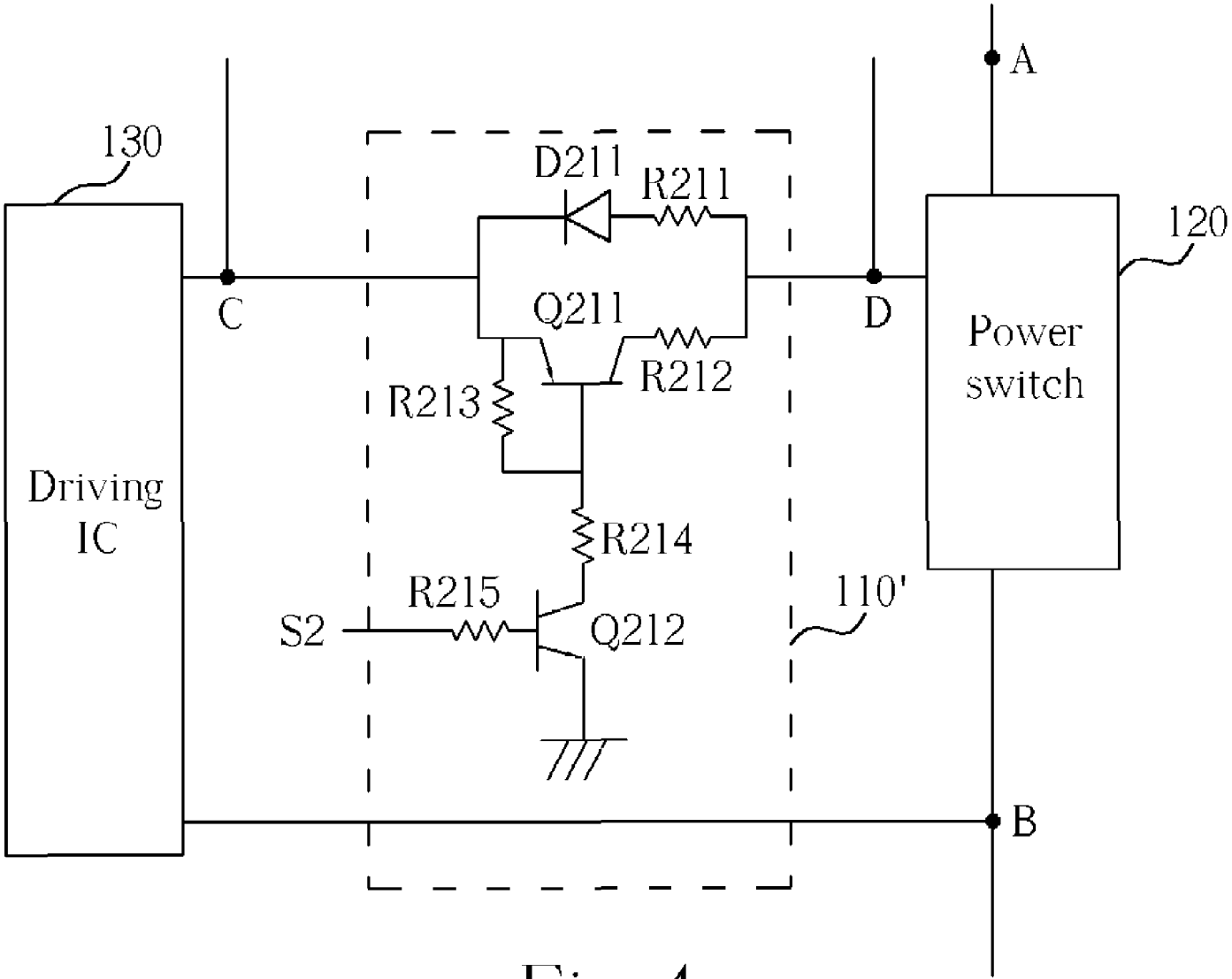
FIG. 4 is a circuit diagram of another embodiment of the fully-on mode circuit.

Please refer to FIG. 4. FIG. 4 is a circuit diagram of another embodiment of the fully-on mode circuit 110'. Differing from the fully-on mode circuit 110 shown in FIG.2 in which the emitter of transistor Q212 is electrically connected to node B, the fully-on mode circuit 110' has the emitter of transistor Q212 is electrically connected to ground.

The present invention can also be implemented with two or more multi-mode switches 100 coupled in parallel. These switches can have different variable rates of resistance for PDP or other applications. In addition, when these paralleled switches are all in fully on-mode, they can share the current in loop together.

In summary, the present invention provides a single power switch that can accomplish switching between three different modes of operation that traditionally required at least two power switches. Through the use of the present invention, the number of power switches can be reduced. Furthermore, power loss due to the power switch can be reduced along with the overall cost of the power switch.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multiple mode switch comprising:

an input signal interface for receiving a first input signal and a second input signal and producing a combined input signal;

a driving circuit for receiving the combined input signal generated by the input signal interface and producing driving signals accordingly;

a resistor mode circuit electrically connected to a first output of the driving circuit, to a first node, and to a second node for enabling the multiple mode switch to operate in variable resistor mode or in large resistor mode;

a fully-on mode circuit electrically connected to the second input signal, the first output of the driving circuit, and the second node for enabling the multiple mode switch to operate in fully-on mode; and a power switch electrically connected to the first node, the second node, and a third node for controlling switching of the multiple mode switch between off mode, fully-on mode, and variable resistor mode or large resistor mode.

2. The multiple mode switch of claim 1, wherein the resistor mode circuit comprises:

a first resistor and a variable resistor electrically connected in series between the first output of the driving circuit and the second node; and a capacitor and a second resistor electrically connected in series between the first node and the second node.

3. The multiple mode switch of claim 2, wherein the power switch comprises a MOS transistor having a gate electrically connected to the second node, a source or drain electrically connected to the first node, and the other of the source or drain electrically connected to the third node.

4. The multiple mode switch of claim 3, wherein the power switch further comprises a resistor electrically connected between the second node and the third node.

5. The multiple mode switch of claim 3, wherein the power switch further comprises a Zener diode having a cathode electrically connected to the second node and an anode electrically connected to the third node.

6. The multiple mode switch of claim 5, wherein the fully-on mode circuit comprises:

a diode and a first resistor electrically connected in series between the first output of the driving circuit and the second node;

a first BJT transistor having an emitter electrically connected to the first output of the driving circuit;

a second resistor electrically connected between the second node and a collector of the first BJT transistor;

a third resistor electrically connected between the emitter of the first BJT transistor and a base of the first BJT transistor;

a fourth resistor having a first end electrically connected to the base of the first BJT transistor;

a second BJT transistor having a collector electrically connected to a second end of the fourth resistor and an emitter electrically connected to ground; and a fifth resistor electrically connected between a base of the second BJT transistor and the second input signal.

7. The multiple mode switch of claim 6, wherein the diode of the fully-on mode circuit comprises a cathode electrically connected to the first output of the driving circuit and an anode electrically connected to the first resistor of the fully-on mode circuit.

8. The multiple mode switch of claim 3, wherein the power switch is a metal-oxide-semiconductor field effect transistor or an insulated gate bipolar transistor.

9. The multiple mode switch of claim 3, wherein the fully-on mode circuit comprises:

a diode and a first resistor electrically connected in series between the first output of the driving circuit and the second node;

a first BJT transistor having an emitter electrically connected to the first output of the driving circuit;

a second resistor electrically connected between the second node and a collector of the first BJT transistor;

a third resistor electrically connected between the emitter of the first BJT transistor and a base of the first BJT transistor;

a fourth resistor having a first end electrically connected to the base of the first BJT transistor; a second BJT transistor having a collector electrically connected to a second end of the fourth resistor and an emitter electrically connected to the third node; and a fifth resistor electrically connected between a base of the second BJT transistor and the second input signal.

10. The multiple mode switch of claim 9, wherein the diode of the fully-on mode circuit comprises a cathode electrically connected to the first output of the driving circuit and an anode electrically connected to the first resistor of the fully-on mode circuit.

11. The multiple mode switch of claim 1, wherein the third node is electrically connected to a second output of the driving circuit.

12. The multiple mode switch of claim 1, wherein the input signal interface comprises:

a first diode having an anode receiving the first input signal and a cathode electrically connected to an output;

a second diode having an anode receiving the second input signal and a cathode electrically connected to the output; and a resistor electrically connected between the output and ground, wherein the input signal interface produces the combined input signal at the output of the input signal interface.

* * * * *